United States Patent [19]

Theys

[11] 4,081,973

[45] Apr. 4, 1978

[54] MULTI LEVEL PRESSER-FOOT DEVICE

[75] Inventor: Andre Theys, Wondelgem, Belgium

[73] Assignee: Fabrique Nationale Herstal S.A., Herstal, Belgium

[21] Appl. No.: 771,337

[22] Filed: Feb. 23, 1977

[30] Foreign Application Priority Data

Mar. 31, 1976 Belgium ..... 254921

[51] Int. Cl.[2] ..... D04B 7/04

[52] U.S. Cl. ..... 66/64

[58] Field of Search ..... 66/60, 64, 157

[56] References Cited

U.S. PATENT DOCUMENTS

| | | | |
|---|---|---|---|
| 2,434,782 | 1/1948 | Alexander et al. | 66/147 |
| 3,007,324 | 11/1961 | Bram | 66/64 |
| 3,049,900 | 8/1962 | Bram | 66/60 |
| 3,153,922 | 10/1964 | Bram | 66/64 |
| 3,613,401 | 10/1971 | Jeffcoat et al. | 66/60 |
| 3,685,317 | 8/1972 | Giachetti | 66/64 |
| 3,839,884 | 10/1974 | Flavell et al. | 66/64 |
| 3,842,623 | 10/1974 | Flavell et al. | 66/64 |
| 3,952,553 | 4/1976 | Kohler | 66/64 |
| 3,973,416 | 8/1976 | Kohler | 66/64 |

FOREIGN PATENT DOCUMENTS

| | | | |
|---|---|---|---|
| 619,967 | 4/1927 | France | 66/64 |
| 340,005 | 9/1959 | Switzerland | 66/64 |
| 382,361 | 11/1964 | Switzerland | 66/64 |

*Primary Examiner*—Mervin Stein
*Assistant Examiner*—Andrew M. Falik
*Attorney, Agent, or Firm*—Bacon & Thomas

[57] ABSTRACT

An improved presser foot device for straight bar knitting machines with double V needle beds, characterized by the fact that means are provided whereby the presser foot can be moved by the program controller of the machine automatically from one to another of two preselected hold down levels, one of which is appropriate for "rib border" knitting and the other for "jersey" knitting. A specific shape of presser foot is also disclosed, comprising a thin, flat configuration including a first wide section located towards the advancing end of the presser foot, a second markedly narrower section connected to the first section at an abrupt change in width and trailing the first section with respect to the advancing direction of the presser foot, and a third section trailing the second section, the third section being wider than the second section and connected to the latter along a gradually tapered section.

6 Claims, 5 Drawing Figures

MULTI LEVEL PRESSER-FOOT DEVICE

BACKGROUND OF THE INVENTION

The present invention relates to an adjustable presser foot device for straight bar knitting machines with double V-shaped needle beds which permits the machine to knit rib border and jersey without the need for any particular manual interference or interruption of machine operation.

Passing from one mode of knitting to another in the prior art was limited to machines equipped with a conventional reed or roller traction device. With a presser foot type of machine, however, it was necessary, in order to fabricate composite panels or pieces, either to knit the jersey part and to later attach thereto one of several separately knitted rib top borders, or to knit false rib borders with elastic thread, of the type produced on single cylinder circular knitting machines.

A knitting machine employing a conventional presser foot device without means for enabling the presser foot to automatically function along two separate levels is disclosed in U.S. Pat. No. 3,613,401 issued to JEFFCOAT et al on Oct. 19, 1971. The optimum operating levels of presser feet when rib and jersey are being knit are described fully in the specification of that patent, and the general layout of a knitting machine using presser feet of the general type disclosed herein is fully described.

The present invention has application in such an environment, and the present drawings and specification describe only those details necessary for a person skilled in the relevant art to understand and practice the invention.

Reference is also made to U.S. Pat. No. 3,842,623 issued to FLAVELL et al on Oct. 22, 1974 for additional description of the state of the art of knitting machines using presser foot elements.

SUMMARY OF THE INVENTION

The device according to the present invention comprises means which permit the presser foot to be displaced automatically from one to another of two preselected pressing down levels in response to control signals from the machine program control. One of the levels (a higher level) is appropriate for rib border knitting, and the other (a lower level) is appropriate for jersey knitting.

In this invention, applicant prefers that the distance between the higher level and the lower level be at least equal to the length of one loop of the fabric being knit by the machine.

The active section of the presser foot during jersey knitting exerts a friction upon the knitwear between the needle beds which is sufficient to assure the operation of the needle latches and to prevent the previously formed loops from leaving (jumping off) the needles. For this purpose, the active section of the presser used for jersey knitting is greater than the active area for the rib border knitting.

Locating the presser foot at the required level in accordance with a preferred embodiment of this invention is carried out by pneumatic actuators controlled by the program control system of the knitting machine.

BRIEF DESCRIPTION OF THE DRAWINGS

With reference to the appended drawings which describe one embodiment of the invention.

DETAILED DESCRIPTION

Figure 1:
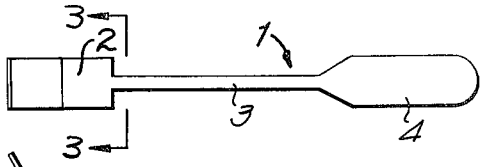
FIG. 1 is a top view of a presser foot constructed in accordance with the present invention.
Figure 2:
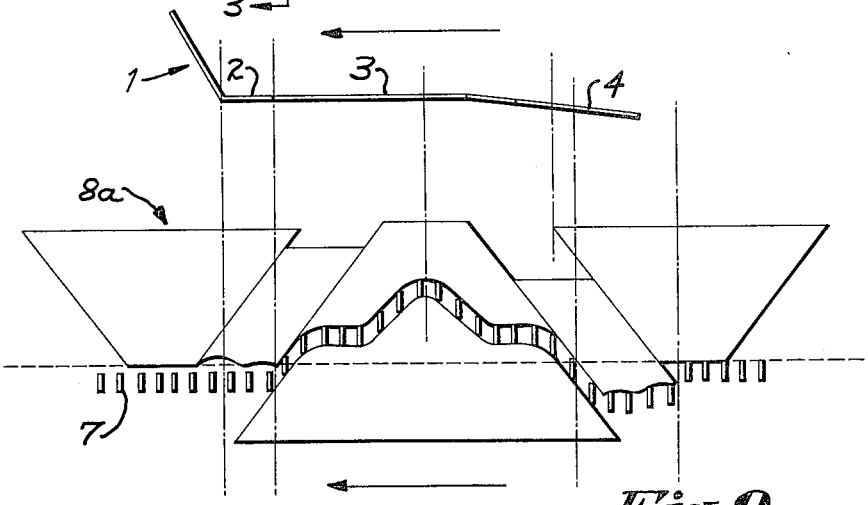
FIG. 2 is a side elevation view of the presser foot of FIG. 1, shown in relation to the needle actuating cam assembly of the machine.
Figure 5:
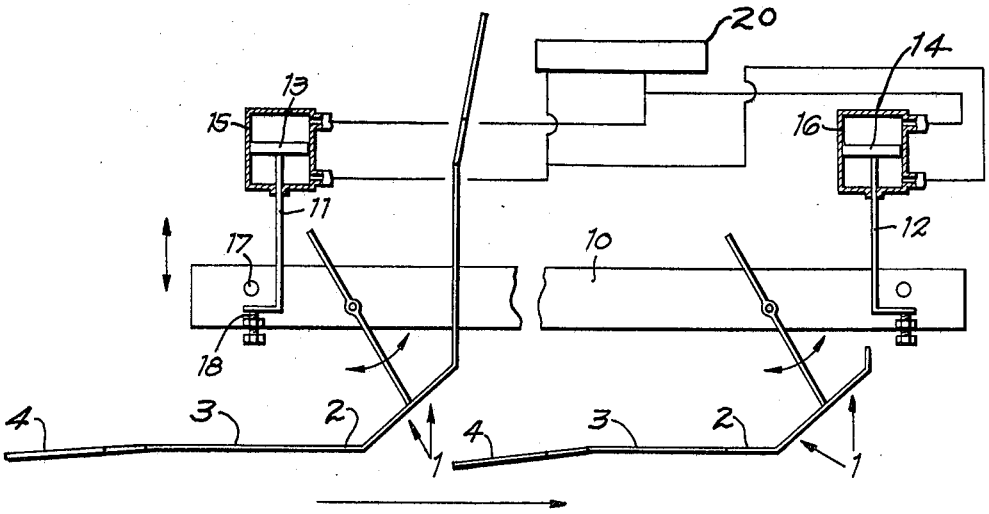
FIG. 5 shows the presser foot fitted with level changing means.

The presser foot 1, shown in the drawings, more particularly in FIGS. 1 and 2, comprises three active sections: looking at the presser foot from left to right, the foot comprises a wide section 2, a narrow section 3 and a widened end section 4. The upturned section **2*a* to the left in FIGS. 1 and 2 is normally inactive and serves to connect the presser foot to the machine structure, as shown in FIG. 5**.

The transition from section 2 to section 3 consists of an abrupt change of the cross-section of the presser foot, whereas the transistion between sections 3 and 4 is much more gradual, actually in the form of a tapered section.

Section 4 preferably lies in a plane that slants downwardly from the plane of section 3 at an angle of about 6° to 7°, and section 2 is coplanar with section 3.

The presser foot performs the general pressing functions described in applicant's BELGIAN Pat. No. 839,081, as well as the functions carried out by the presser foot of the type shown in U.S. Pat. No. 3,613,401. Sections 3 and 4 of the presser foot in particular perform the functions of the presser foot shown in the BELGIAN Patent. The advancing direction of the presser foot 1 in its active position is towards the left as viewed in FIGS. 1 and 2.

Figure 3:
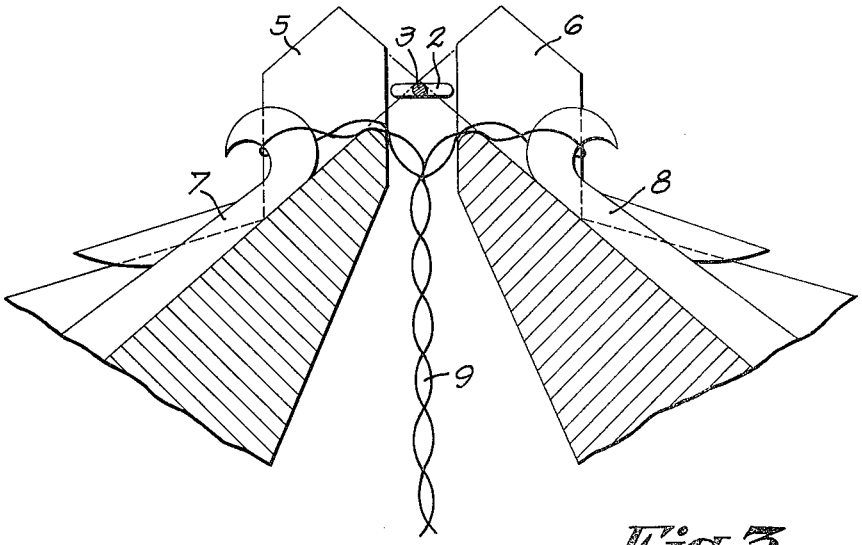
FIGS. 3 and 4 are schematic cross-sections of the knitting area of a flat V bed knitting machine showing the presser foot at the area of line 3—3 of FIG. 1, respectively showing the two levels at which the presser foot can be moved during operation of the machine.
Figure 4:
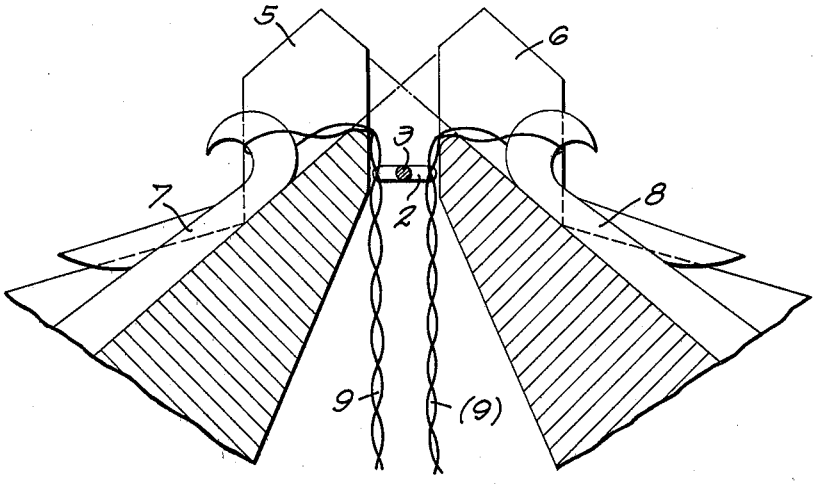

Two pairs of presser feet are normally provided in machines of this type as illustrated in U.S. Pat. No. 3,613,401 and as illustrated in FIG. 5. FIGS. 3 and 4 schematically show the two operating levels of the presser foot in the rib and jersey positions, respectively. In these figures, the needle beds are schematically shown at 5 and 6, the needles at 7 and 8, the needle cams at **8*a*, and the knit wear at 9. In this respect it should be noted that FIG. 4 shows the fabrication of jersey knitting either in tubular or in twin panel configuration for which the presser foot is particularly well adapted by reason of the configuration of section 4**.

It can be seen that when knitting rib border, sections 3 and 4 are active, whereas section 2 is mainly active when jersey is being knit in the machine. In the latter case, section 2 has the usual purpose of exerting a friction force upon the knit wear loops 9, such friction eliminating the need for a conventional traction comb or the like which normally holds down the knitted fabric.

The difference in width of sections 2 and 3 shall be chosen as a function of the division, the gauge, the kind of fabric and of the loop height of the machine and the knit fabric.

The distance between the two levels which may be occupied by the presser foot 1 is at least equal to the length of one loop of the knit wear being knit.

The presser foot shall preferably be made of spring steel.

In a highly simplified form of embodiment of the invention, the presser foot may be freely floating so that it normally occupies its lower position but "rises" towards its higher position, on top of the loops, when knitting rib border.

In actual practice, a more elaborate system is preferred in which the level adjustment is made by the program control of the machine automatically while the machine is carrying out a knitting operation. This is not to say that the level adjustment is necessarily made while the loops are actually being formed, but simply that the level adjustment is made automatically without manual intervention during an overall knitting operation.

An example of such a setup is schematically shown in FIG. 5, wherein two pairs of presser feet according to the invention are fitted on a reciprocating mobile bar 10, supported by rods 11 and 12 attached to two pistons 13 and 14 connected to pneumatic cylinders 15 and 16.

The bar 10 reciprocates in time with the needle cam 8*a* in a manner well known in this art, and as exemplified in the above cited prior art references. See also U.S. Pat. No. 3,685,317 issued to ALFREDO GIACHETTI et al on Aug. 22, 1972, wherein a support bar is described as depending from above needle bed, but moveable therealong with the needle cam box.

In practice, two pairs of presser feet are mounted on bar 10 as illustrated in FIG. 5, each pair having an active portion operative during each part of a machine stroke. In FIG. 5, the presser feet are shown in operative position for left-to-right stroke. The cylinders 15, 16 are also mounted for movement with the bar 10 in accordance with this embodiment as is obvious from their connection to bar 10.

It should be understood that the invention in its broadest sense contemplates any suitable adjustable and controllable support for the presser foot that enables it to be automatically set at either of two operating levels, since this is the gist of the present invention.

In order to allow the fine adjustment of the two selected levels, which might vary from one type of knitwear and/or thread to another, the connections between rod 11, 12 and bar 10 are made adjustable, for instance by means of a device with fixed adjustable stops, respectively 17 and 18.

Actuation of cylinders 15 and 16 is controlled in a suitable manner that permits the level of the presser feet to be automatically set in accordance with the setting of the knit design (rib border or jersey). Usually, the cylinders 15, 16 will be actuated by the machine program control 20 shown schematically in FIG. 5 which may comprise, for example, an aperture card that operates with electrically conductive finger elements that sense apertures in the card for controlling the knitting machine, or any other suitable control means well known in this art.

With the described device, it is possible to proceed continuously and automatically from rib border to jersey knitting and vice versa, which was not possible with previously known presser foot machines.

It is obvious that numerous modifications can be made to the above described embodiment, without departing from the scope of the invention which is intended to be limited only by the claims appended hereto.

What is claimed is:

1. In a straight bar knitting machine having double V-shaped needle beds that support and guide independently moveable needles, a program control for the knitting machine, a presser foot arranged to reciprocate along and between the needles, th improvement comprising means automatically responsive to the program control for adjusting the level at which the presser foot reciprocates between either of two preselected levels, one of said levels being above the top of the needle beds and just below the path of travel of the needles, the other of said levels being between and closely adjacent the top edges of the needle beds.

2. The knitting machine according to claim 1, wherein said presser foot is supported by a bar that reciprocates during knitting, and said means for adjusting the level at which the presser foot reciprocates includes means for raising and lowering said bar.

3. The knitting machine according to claim 2, wherein said means for raising and lowering said bar comprises a fluid actuator system moveable at least in part with the bar.

4. The knitting machine according to claim 1, wherein the distance between said preselected levels corresponds substantially to the length of one loop of fabric being knitted while the machine is operative.

5. The knitting machine according to claim 1, wherein said presser foot has a thin, flat configuration that is characterized by a first wide section located towards the advancing end of the presser foot; a second markedly narrower section connected to the first section at an abrupt change in width and trailing said first section with respect to the advancing direction of the presser foot; and a third section trailing the second section, said third section being wider than the second section and connected to the latter along a gradually tapered section.

6. The knitting machine according to claim 4, wherein said first and second sections are substantially coplanar and said third section is inclined downwardly approximately 6° to 7° from said second section.

* * * * *